US006094024A

United States Patent [19]

Westlake

[11] Patent Number: 6,094,024

[45] Date of Patent: Jul. 25, 2000

[54] DYNAMIC BRAKING SYSTEM FOR A MOTORIZED LIFTING MECHANISM

[76] Inventor: J. Fred Westlake, 1783 Allanport Road, Allanburg, Ontario, Canada, L0S 1A0

[21] Appl. No.: 09/204,686

[22] Filed: Dec. 3, 1998

[30] Foreign Application Priority Data

Jul. 29, 1998 [CA] Canada ..... 2244340

[51] Int. Cl.[7] ..... G10D 11/00

[52] U.S. Cl. ..... 318/375; 318/759; 318/760

[58] Field of Search ..... 318/759, 760–762, 318/375–377, 380, 757

[56] References Cited

U.S. PATENT DOCUMENTS

| | | | |
|---|---|---|---|
| Re. 13,019 | 9/1909 | Hall et al. . | |
| 1,916,415 | 4/1933 | Cook . | |
| 2,110,906 | 3/1938 | Colbert | 172/179 |
| 2,155,373 | 4/1939 | Cooke | 172/179 |
| 2,298,188 | 10/1942 | Wright | 172/152 |
| 2,421,080 | 5/1947 | Newman | 172/152 |
| 2,590,453 | 3/1952 | Pettit | 318/274 |
| 2,785,357 | 3/1957 | King | 318/140 |
| 3,535,605 | 10/1970 | Halvorson et al. | 318/258 |
| 4,533,021 | 8/1985 | Perez de la Orden | 187/29 R |
| 5,457,372 | 10/1995 | Pignatelli et al. | 318/760 |

*Primary Examiner*—Stanley J. Witkowski
*Assistant Examiner*—Marlon T. Fletcher
*Attorney, Agent, or Firm*—Dimock Stratton Clarizio; Mark B. Eisen

[57] ABSTRACT

A dynamic braking system for a motorized lifting mechanism such as a crane, hoist or the like allows the load to be lowered at a controlled rate during a power failure. An auxiliary power source is activated to apply an excitation current to the stator windings, creating a static magnetic field. When the brake is released the rotor rotates in the static magnetic field, generating an A.C. voltage that is rectified and applied to the stator, thereby increasing the strength of the static magnetic field. An equilibrium is reached, and the load is lowered at a controlled rate. In the preferred embodiment the A.C. voltage is supplied through an adjustable resistor, allowing the lowering rate to be selectively controlled.

20 Claims, 2 Drawing Sheets

DYNAMIC BRAKING SYSTEM FOR A MOTORIZED LIFTING MECHANISM

FIELD OF INVENTION

The present invention relates to lifting mechanisms such as electric cranes, hoists and the like. In particular, the present invention relates to a dynamic braking system for an electric lifting motor which allows a suspended load to be lowered at a controlled rate during a power failure.

BACKGROUND OF THE INVENTION

Motorized cranes, hoists and like lifting devices using electric lifting motors are commonly used to suspend a load for transport, assembly, repair and other commercial and industrial purposes. In such devices a suspended load cannot be lowered during a power failure, as the overhauling force of the load would accelerate the rotor to such high speeds that it would disintegrate the rotor windings, resulting in expensive damage to the crane or hoist and costly down-time.

This is particularly problematic in lifting mechanisms which suspend a load from an electromagnet. In such devices the load remains suspended by magnetic attraction to a powerful electromagnet as long as the electromagnet is energized, and a power failure can thus release the load causing serious damage to the load and surrounding premises, and potentially personal injury.

A battery backup system can be employed to keep the load suspended from the electromagnet for a brief period, usually 15 to 30 minutes, which allows personnel to vacate the area to avoid injury. However, since the load cannot be safely lowered during a power failure, if power is not restored before the backup power supply is depleted the load will be released from the electromagnet and damage to the load and its surroundings will nevertheless result. Where power is restored before the battery backup system fails the load can then be safely lowered, however the battery backup system must be recharged before safe operation of the lifting mechanism can resume, which in some cases can result in many hours of down-time for the crane or hoist.

SUMMARY OF THE INVENTION

The present invention overcomes this problem by providing a dynamic braking system for a lifting mechanism utilizing an electric lifting motor, which allows a suspended load to be lowered at a controlled rate during a power failure.

The invention accomplishes this by applying an excitation current to the stator to energize the stator windings, creating a static magnetic field within the stator. When the crane or hoist brake is released the potential energy of the load causes the rotor to rotate in the magnetic field, which generates an A.C. current across the rotor windings. The A.C. current is rectified and a selected portion of the A.C. current is supplied to the stator windings as a D.C. braking current, increasing the strength of the static magnetic field within the stator. An equilibrium is reached, at which point the load is lowered at a controlled rate.

In the preferred embodiment for a lifting mechanism utilizing an electromagnet to suspend the load, the excitation current applied to the stator is supplied by the electromagnet battery backup system. When the load has been safely lowered the battery backup system can be switched off without waiting for power to resume, so depletion of the power reserve is minimal. Recharging time is therefore significantly decreased, minimizing the down-time of the lifting mechanism.

Also, in the preferred embodiment the rate of rotor rotation can be controlled by an adjustable resistor, which permits the operator to selectively adjust the amount of braking current applied to the stator, and optionally using the existing resistor network to dissipate a portion of the A.C. current to thereby reduce the level of the D.C. braking current.

The present invention thus provides a dynamic braking system for an electric lifting motor having a rotor rotating within a stator and powered by a primary power source, comprising a secondary power source electrically connected to windings of the stator for supplying a D.C. excitation current to the stator to generate a magnetic field therein, balancing resistors electrically connected to windings of the rotor, for balancing an electric current output from the rotor when the rotor rotates in the magnetic field and diverting a selected portion of the electric current output from the rotor to supply a braking current to the stator, and a connection between the balancing resistors and the windings of the stator comprising a semi-conductor for applying the braking current to the stator, wherein the D.C. braking current opposes rotation of the rotor so that the lifting motor lowers the load at a controlled rate.

The present invention further provides a lifting device utilizing an electric lifting motor having a rotor rotating within a stator and powered by a primary power source, having a dynamic braking system comprising a secondary power source electrically connected to windings of the stator for supplying a D.C. excitation current to the stator to generate a magnetic field therein, balancing resistors electrically connected to windings of the rotor, for balancing an electric current output from the rotor when the rotor rotates in the magnetic field and diverting a selected portion of the electric current output from the rotor to supply a braking current to the stator, and a connection between the balancing resistors and the windings of the stator comprising a semi-conductor for applying the braking current to the stator, wherein the D.C. braking current opposes rotation of the rotor so that the lifting motor lowers the load at a controlled rate.

The present invention further provides a method of lowering a load suspended from a lifting device comprising an electric lifting motor having a rotor rotating within a stator and powered by a primary power source, comprising the steps of supplying a D.C. excitation current to the stator to generate a magnetic field therein, balancing a current output by the rotor generated by rotation of the rotor within the magnetic field to produce a D.C. braking current, and supplying the D.C. braking current to the stator through a semiconductor, whereby the D.C. braking current opposes rotation of the rotor so that the lifting motor lowers the load at a controlled rate.

BRIEF DESCRIPTION OF THE DRAWINGS

In drawings which illustrate by way of example only a preferred embodiment of the invention.

DETAILED DESCRIPTION OF THE INVENTION

Figure 1:
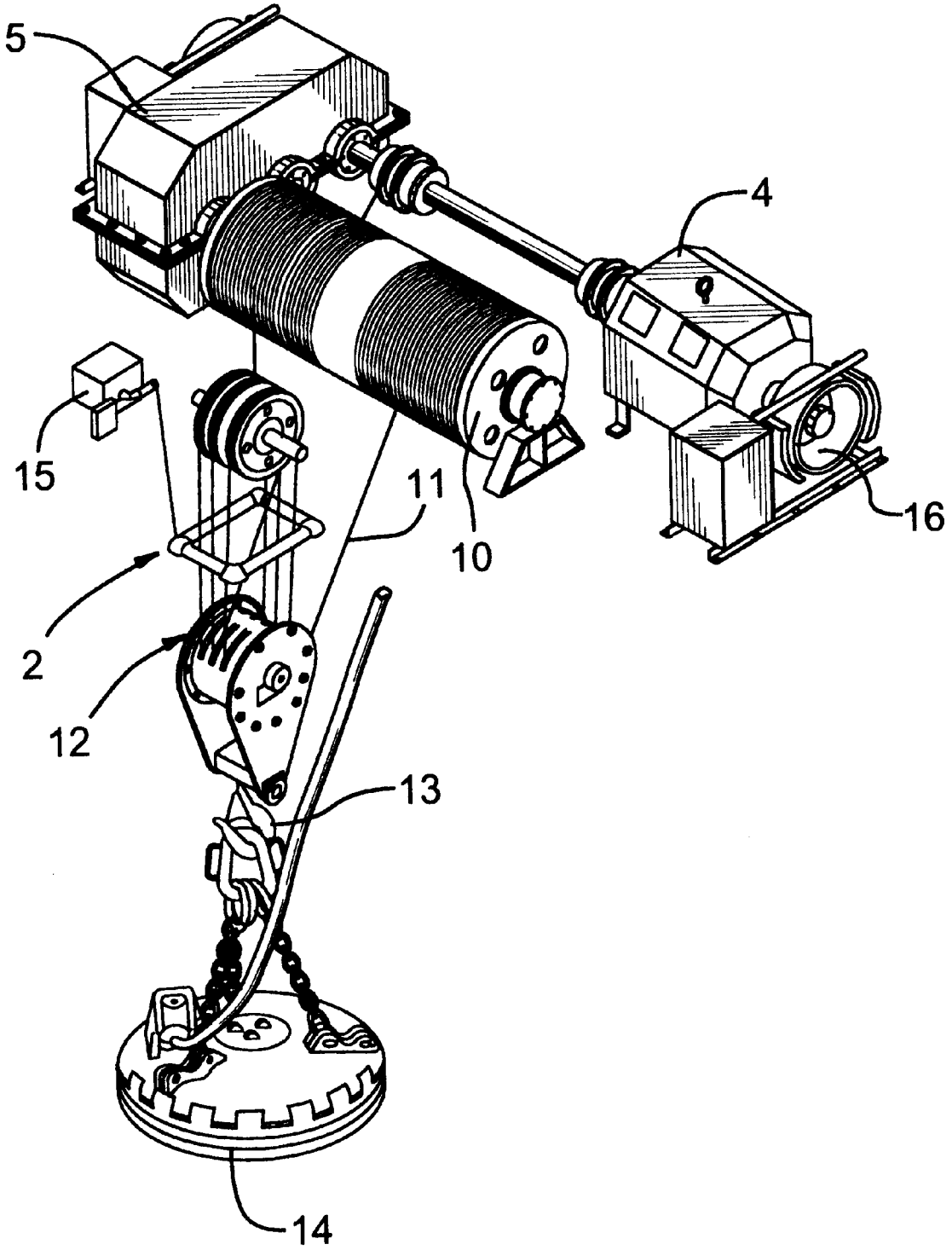
FIG. 1 is a schematic elevation of an electric lifting device embodying the invention.

FIG. 1 illustrates a hoist 2 having an A.C. electric lifting motor 4. Through gear train 5 the motor 4 conventionally drives a drum 10, around which is wound a cable 11 through a winch 12 having a hook 13 for lifting a load (not shown). In the embodiment shown the hoist 2 lifts an electromagnet 14 coupled to the hook 13, the load being suspended by magnetic attraction to the electromagnet 14. The motor 4 and the electromagnet 14 are powered by a primary power source (not shown), which is typically a three phase mains power supply distributed to the premises by the local power utility. In the embodiment shown the hoist 2 is provided with a magnetic drum-type brake 16 actuated by a D.C. electric current through contactors 17 for arresting rotation of the motor 4, to suspend the load at a desired height, which is also powered by the primary power source through a converter (not shown). In a typical hoist 2 a limit switch 15 actuates the brake 16 automatically when the hoist 2 reaches a selected upper limit.

The hoist 2 thus far described is well known to those skilled in the art. The invention will be described in relation to the hoist 2 illustrated in FIG. 1, however it will be appreciated that the invention applies equally to cranes, winches and other lifting mechanisms including elevators and the like which utilize an electric (either A.C. or D.C.) lifting motor 4. The invention can also be employed in lifting devices utilizing other types of braking systems, including mechanical, rheostatic, D.C. dynamic and eddy current braking systems.

Figure 2:
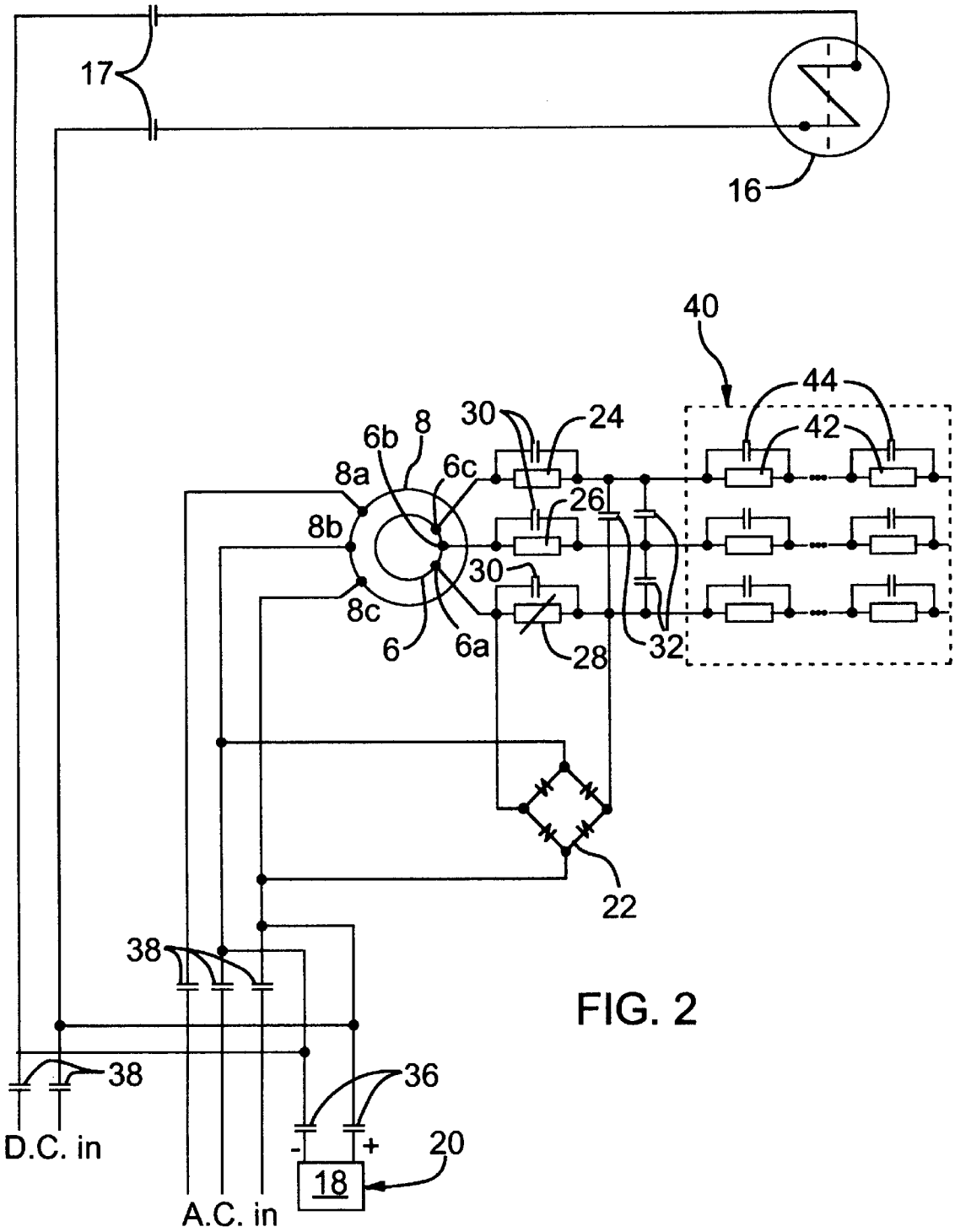
FIG. 2 is a circuit diagram of a dynamic braking system according to the invention.

FIG. 2 illustrates the hoist 2 of FIG. 1 employing a preferred embodiment of the dynamic braking system of the invention. The motor 4 comprises a rotor 6 having terminals 6*a*, 6*b*, 6*c* rotating within a stator 8 having terminals 8*a*, 8*b*, 8*c*. The hoist 2 typically includes a resistor network 40 having resistors 42 coupled to the rotor terminals 6*a*, 6*b*, 6*c* in series, and in parallel with contactors 44 which allow the operator to selectively bypass any desired portion of the resistor network 40 by closing sets of contactors 44 to control the current at the rotor terminals 6*a*, 6*b*, 6*c*.

The braking system of the invention is designed to lower a load at a controlled rate in the event of failure of the primary power supply. A secondary power source 20 is connected to the stator terminals 8*a*, 8*b* of the stator 8. The secondary power source 20 is used to apply a relatively small excitation current, in the embodiment shown 32 V D.C., to the windings of the stator 8. In the preferred embodiment the excitation current may be drawn directly from the battery backup system 18 for the electromagnet 14, which thus constitutes the secondary power source 20. Alternatively, the secondary power source 20 may comprise a separate battery system or an electrical generator (not shown). Rotation of the rotor 6 within the static magnetic field created in the stator 8 causes the rotor 6 to generate a current which will be used to supplement the excitation current applied to the stator 8.

The rotor terminals 6*a*, 6*b* and 6*c* of the rotor 6 are connected to balancing resistors 24, 26, 28, the resistance thereof being selected according to the specifications of the lifting motor 4 to preferably produce up to approximately 70% of the rated full load torque at standstill. Preferably at least one resistor, resistor 28 in the embodiment shown, is adjustable for reasons which will be described below. The balancing resistors 24, 26, 28 are connected to the rotor terminals 6*a*, 6*b*, 6*c* in parallel with contactors 30, which are closed when the hoist 2 is in normal operation (i.e. the primary power supply is active), and contactors 32 which are open when the hoist 2 is in normal operation, to bypass the balancing resistors 24, 26, 28.

In a power failure condition, upon activation of the braking system the contactors 30 are opened to isolate the resistor network 40, and the contactors 32 are closed to divert the rotor output current through the resistors 24, 26, 28, which convey the current generated by the rotor 6 to the stator terminals 8*a*, 8*b*, 8*c* through a semiconductor, in the embodiment shown a Wheatstone bridge rectifier 22. It will be appreciated that the rectifier 22 may be connected to any of the rotor terminals 6*a*, 6*b* or 6*c*, the outputs thereof being connected in the dynamic braking mode because contactors 32 are closed. The output of the rectifier 22 is connected to the stator terminals 8*a*, 8*b* of the stator 8, in parallel with the auxiliary power source 20

A rectifier 22 is employed in the embodiment shown because the lifting motor 4 is an A.C. motor, so the A.C. current generated by the rotor 6 during dynamic braking must be rectified before being applied to the stator 8 in order to generate a static magnetic field. In the case of a D.C. lifting motor the rectifier 22 would be unnecessary, but a semiconductor device would be interposed between the outputs of the resistors 24, 26, 28 and the stator terminals 8*a*, 8*b*, 8*c* to prevent current from the secondary power source 20 from backing up into the rotor 6.

The preferred embodiment of the invention operates as follows. In the event of a power failure, the battery backup system 18 switches on automatically to energize the electromagnet 14. The brake 16 is engaged automatically when the primary power supply fails, as is conventional. A load suspended by the hoist 2 thus remains suspended until lowered by an operator as described below.

In the embodiment shown the battery backup system 18 is used as the auxiliary power source 20. The battery backup system 18 is activated by a master switch closing contactors 36 (for safety reasons, in case the primary power supply is restored during the lowering operation, contactors 38 are simultaneously opened to cut off the primary power supply). This is preferably automatic, responsive to a voltage or current sensor (not shown) that detects failure of the primary power supply.

Upon closing contactors 36 the battery backup system 18 supplies a D.C. excitation current to the stator 8 to generate a static magnetic field within the stator windings. In the preferred embodiment a current sensing relay 50 detects the level of current supplied by the battery backup system 18, and the brake release is disabled unless a selected threshold of current, for example 32 V D.C., is detected.

If the minimum excitation current is present the brake 16 can be released to lower the load. As the load starts to free-fall the rotor 6 begins to rotate. The static magnetic field established in the stator 8 by the D.C. excitation current resists rotation of the rotor 6, but is not strong enough to arrest rotation of the rotor 6. The rotor 6 turning in the static magnetic field generates an A.C. voltage across the rotor terminals 6*a*, 6*b*, 6*c* which is output through the balance resistors 24, 26, 28. The A.C. voltage is converted by the rectifier 22 to a D.C. braking current which is output to the stator terminals 8*a*, 8*b*. The braking current is additive to the current supplied by the auxiliary power source 20 and increases the strength of the static magnetic field in direct relation to the rotational speed of the rotor 6, thereby increasing resistance to rotation of the rotor 6.

The potential energy of the load is thus converted to electrical energy which is used to assist in energizing the stator 8. In effect, the invention creates a negative feedback loop initiated by the D.C. excitation current. The D.C. excitation current provides an initial resistance to rotation of the rotor 6. As the rotor 6 accelerates the A.C. voltage generated by the rotor 6 increases, increasing the braking current and thereby increasing the braking influence of the static magnetic field, which further increases resistance to rotation of the rotor 6. At a certain speed an equilibrium is reached, where the rotational speed of the rotor 6 generates sufficient current that the rotor 6 can no longer accelerate, and the load is thus lowered at a controlled rate determined by the equilibrium point.

Thus, the extent of braking provided by the rotor 6 is dependent upon the weight, or overhauling capacity, of the load. A heavier load causes the rotor 6 to accelerate more quickly, and thus generate a stronger braking current, than a lighter load.

In the preferred embodiment at least one of the balancing resistors comprises a variable resistor 28, which allows the operator to control the current supplied to the rectifier 22 and thus permits adjustment of the load lowering rate. As the resistance of resistor 28 is decreased a greater proportion of the current generated by the rotor 6 dissipates in the balance resistors 24, 26, 28, and the current supplied to the rectifier 22 is commensurately reduced, allowing the speed of the rotor 6 to increase. Similarly, as the resistance of resistor 28 is increased a greater proportion of the current generated by the rotor 6 is supplied to the rectifier 22, which reduces the speed of the rotor 6.

The speed of the rotor 6 can alternatively be increased by applying a resistance between the auxiliary power source 20 and the stator terminals 8*a* or 8*b*, by introducing a rheostat or other voltage/current controlling device between the balancing resistors 24, 26, 28 and the stator terminals 8*a*, 8*b*, 8*c*, or by diverting a selected portion of the current generated by the rotor 6 through a load, which can be any electrical load in the vicinity of the hoist 2. The speed of the rotor 6 can also be adjusted in stepped increments by dissipating a selected portion of the current generated by the rotor 6 through the resistor network 40, by closing contactors 30 and selectively closing contactors 44 in sequence to vary the resistance of the network 40.

In each case, the initial D.C. excitation current must be supplied to energize the stator 8 in order for the dynamic braking process to operate. The lifting motor 4 then acts as a dynamic braking generator for overhauling loads, the current produced by the rotor 6 being directly proportional to the weight of the load. The portion of the rotor current applied as a braking current determines the rate of lowering of the load. The system of the invention may optionally include an overspeed switch (not shown) which activates the brake 16 if the lowering rate exceeds a safe threshold.

Once the load has been safely lowered the battery backup system 18 can be deactivated. Depletion of the power reserve in the battery backup system 18 is minimal, because of its short duration of operation. Recharging time is therefore significantly decreased, minimizing the down-time of the hoist 2. The system of the invention produces higher light load braking speeds than would be available using constant stator excitation, with no danger of stator burnout, while providing safe and stable operation under heavy or transient overload conditions.

A preferred embodiment of the invention has been thus described by way of example only. Without limiting the foregoing, the invention has been described in relation to a crane 2 which uses an electromagnet 14 to suspend the load 1 and a magnetic brake 14. If mechanical suspending means such as a hook (not shown) is used, even though there is no risk of a load falling from the lifting mechanism it can nevertheless be advantageous to be able to lower the load. Those skilled in the art will appreciate that the invention can be applied to any crane, hoist, winch or other lifting mechanism actuated by an electric motor, and will lower the load at a controlled rate during a power failure, and the invention is intended to include all such variations and adaptations may be made without departing from the scope of the invention as set out in the appended claims.

I claim:

1. A dynamic braking system for an electric lifting motor having a rotor rotating within a stator and powered by a primary power source in normal operation of the lifting motor, comprising a secondary power source electrically connected to windings of the stator for supplying a D.C. excitation current to the stator to generate a magnetic field therein, balancing resistors electrically connected to windings of the rotor, for balancing an electric current output from the rotor when the rotor rotates in the magnetic field and diverting a selected portion of the electric current output from the rotor to supply a braking current to the stator, and a connection between the balancing resistors and the windings of the stator comprising a semi-conductor for applying the braking current to the stator, wherein upon failure of the primary power source the magnetic field generated by the excitation current supplied by the secondary power source to the stator induces a D.C. braking current in the rotor whereby the D.C. braking current opposes rotation of the rotor so that the lifting motor lowers the load at a controlled rate.

2. The dynamic braking system of claim 1 wherein the lifting motor is an A.C. electric motor and the semiconductor device comprises a rectifier having an input electrically connected to the rotor and an output electrically connected to the stator for rectifying an A.C. voltage generated by rotation of the rotor within the magnetic field to generate the braking current.

3. The dynamic braking system of claim 1 wherein the balancing resistors are connected to the rotor through contactors which are biased to an open position to bypass the balancing resistors when the lifting motor is in normal operation and to which are closed when the primary power supply fails to divert an electric current from the rotor through the balancing resistors.

4. The dynamic braking system of claim 1 in which the secondary power source comprises a battery backup system.

5. The dynamic braking system of claim 4 wherein the lifting motor is operatively coupled to an electromagnet and the battery backup system also supplies power to the electromagnet when the primary power source fails.

6. The dynamic braking system of claim 1 in which a resistor network coupled to the lifting motor may selectively engaged to dissipate a portion of the electric current output from the rotor.

7. The dynamic braking system of claim 1 in which a current sensor detects a presence of the excitation current and releases an electrically actuated brake when the excitation current level reaches a selected threshold.

8. A lifting device utilizing an electric lifting motor having a rotor rotating within a stator and powered by a primary power source in normal operation of the lifting device, having a dynamic braking system comprising a secondary power source electrically connected to windings of the stator for supplying a D.C. excitation current to the stator to generate a magnetic field therein, balancing resistors electrically connected to windings of the rotor, for balancing an electric current output from the rotor when the rotor rotates in the magnetic field and diverting a selected portion of the electric current output from the rotor to supply a braking current to the stator, and a connection between the balancing resistors and the windings of the stator comprising a semi-conductor for applying the braking current to the stator, wherein upon failure of the primary power source the magnetic field generated by the excitation current supplied by the secondary power source to the stator induces a D.C. braking current in the rotor whereby the D.C. braking current opposes rotation of the rotor so that the lifting motor lowers the load at a controlled rate.

9. The lifting device of claim 8 wherein the lifting motor is an A.C. electric motor and the semiconductor device comprises a rectifier having an input electrically connected to the rotor and an output electrically connected to the stator for rectifying an A.C. voltage generated by rotation of the rotor within the magnetic field to generate the braking current.

10. The lifting device of claim 8 wherein the balancing resistors are connected to the rotor through contactors which are biased to an open position to bypass the balancing resistors when the lifting motor is in normal operation and to which are closed when the primary power supply fails to divert an electric current from the rotor through the balancing resistors.

11. The lifting device of claim 8 in which the secondary power source comprises a battery backup system.

12. The lifting device of claim 11 wherein the lifting motor is operatively coupled to an electromagnet and the battery backup system also supplies power to the electromagnet when the primary power source fails.

13. The lifting device of claim 8 in which a resistor network coupled to the lifting motor may selectively engaged to dissipate a portion of the electric current output from the rotor.

14. The dynamic braking system of claim 8 in which a current sensor detects a presence of the excitation current and releases an electrically actuated brake when the excitation current level reaches a selected threshold.

15. A method of lowering a load suspended from a lifting device comprising an electric lifting motor having a rotor rotating within a stator and powered by a primary power source in normal operation of the lifting device, comprising the steps of (a) upon failure of the primary power source, connecting the secondary power source to the stator whereby the secondary power source supplies a D.C. excitation current to the stator to generate a magnetic field therein, (b) balancing a current output by the rotor generated by rotation of the rotor within the magnetic field to produce a D.C. braking current, and (c) supplying the D.C. braking current to the stator through a semiconductor, wherein upon failure of the primary power source the magnetic field generated by the excitation current supplied by the secondary power source to the stator induces a D.C. braking current in the rotor, whereby the D.C. braking current opposes rotation of the rotor so that the lifting motor lowers the load at a controlled rate.

16. The method of claim 15 wherein the lifting motor is an A.C. electric motor and the semiconductor device comprises a rectifier having an input electrically connected to the rotor and an output electrically connected to the stator, including the step of rectifying an A.C. voltage generated by rotation of the rotor within the magnetic field to generate the braking current.

17. The method of claim 15 including after step (a) the step of releasing an electrically actuated brake arresting rotation of the rotor.

18. The method of claim 17 including employing a current sensor to detect a presence of the excitation current and releasing the brake when the excitation current reaches a selected threshold.

19. The method of claim 15 including the step of adjusting a portion of the current output by the rotor to be applied to the stator as a braking current.

20. The method of claim 15 including the step of selectively engaging a resistor network coupled to the lifting motor to dissipate a portion of the electric current output from the rotor.

* * * * *